United States Patent [19]

Teratsuji et al.

[11] Patent Number: 5,054,134

[45] Date of Patent: Oct. 8, 1991

[54] UPPER LAYER WATER FLOW TYPE CIRCULATING WATER POOL

[75] Inventors: Osamu Teratsuji, Ichikawa; Keiichi Nishimura, Urawa; Yoshiro Moriya, Matsudo; Yukihiko Ueda, Yokohama, all of Japan

[73] Assignee: Ishikawajima-Harima Jukogyo Kabushiki Kaisha, Tokyo, Japan

[21] Appl. No.: 559,987

[22] Filed: Jul. 30, 1990

Related U.S. Application Data

[63] Continuation of Ser. No. 311,652, Feb. 15, 1989, abandoned.

[30] Foreign Application Priority Data

Aug. 31, 1988 [JP] Japan ..... 63-217988
Aug. 31, 1988 [JP] Japan ..... 63-217989

[51] Int. Cl.[5] ..... E04H 4/12
[52] U.S. Cl. ..... 4/488
[58] Field of Search ..... 4/488, 491, 492, 507, 4/508; 405/79

[56] References Cited

U.S. PATENT DOCUMENTS 4,515,500 5/1985 Bastenhof ..... 4/491 X
4,539,719 9/1985 Schuster et al. ..... 4/491
4,730,355 3/1988 Kreinbihl et al. ..... 4/491

FOREIGN PATENT DOCUMENTS 0218327 4/1987 European Pat. Off. ..... 4/488
24481 12/1962 German Democratic Rep. .... 4/488

*Primary Examiner*—Charles E. Phillips

[57] ABSTRACT

In a circulating pool main body which defines a swimming pool or tank, a bottom partition wall and front and rear curved partition walls are disposed and spaced apart by a suitable distance from the bottom and the front and rear curved portions of the main body, thereby defining a water circulation passage having an outlet opening to an upper upstream end of the swimming tank or pool and an inlet at the upper downstream end of the swimming tank or pool so that only the upper water layer of the body of water in the swimming tank or pool is forced to flow. Furthermore, one or more swingable blades or vanes are attached to the outlet of the water circulation passage so that the flow rate of the flowing upper water layer in the swimming tank or pool and its direction may be varied.

1 Claim, 5 Drawing Sheets

UPPER LAYER WATER FLOW TYPE CIRCULATING WATER POOL

This application is a continuation of application Ser. No. 07/311,652, filed Feb. 15, 1989 now abandoned.

BACKGROUND OF THE INVENTION

The present invention relates to an upper layer water flow type circulating water pool in which a beginner can learn how to swim or the intensified training of a swimming player under advice of an instructor can be conducted in the water which is forcibly circulated.

Prior to the description of the present invention, a conventional circulating pool will be briefly described with reference to FIGS. 1 and 2 for the sake of better understand of problems and defects of the conventional circulating water pools which the present invention contemplates to solve.

A circulating pool main body 1 which is mounted on a foundation 2 comprises an upper water passage 4 and a lower water passage 5 which are separated by a horizontally extending partition wall 3 and front and rear curved water passages 6 and 7 which intercommunicate between the upper and lower water passages 4 and 6, respectively.

An observation window 9 is formed in one of the side walls 8 of the main body 1 along a suitable section of the upper water passage 4 and a rectangular opening 10 is defined above the upper water passage 4 and is attached with frames.

A plurality of propellers 11 for producing the water flow are disposed in the lower water passage 5 and are driven by motors 12, respectively, disposed outside of the main body 1. The propellers 11 are rotated by the motors 12 with manually set rotational speeds to produce a water flow which is accelerated in the lower water passage 5, passes through the front curved water passage 6 to flow into the upper water passage, passes through the rear curved water passage 7 and then sucked by the propellers 11. Thus the water in the pool is forcibly circulated.

A swimmer can swim at a predetermined position without countering the water flow.

An instructor or the like may directly observe the swimming forms of a swimmer through the observation window of the side wall 8 without moving along with the swimmer and the swimming forms may be recorded by a video tape recorder or a camera so that a swimmer or a swimming player may quickly learn the correct swimming forms.

The depth of the water in which a swimmer swims is only the upper water layer only in the upper water passage 4, but in the cases of the conventional circulating water pools, the whole water in the upper water passage 4 is forced to circulate so that the diameter of the propellers 11 must be longer, the capacities of the motors 12 must be also greater and therefore both the installation cost and the operation cast become very expensive.

In addition, in the conventional circulating water pools, the direction of the water flow in the upper water passage 4 cannot be arbitrarily changed and the flow rate of the water flow passing through the upper water passage 4 cannot be quickly changed.

In view of the above, a primary object of the present invention is to provide an upper water layer type circulating water pool which can be installed and operated at less costs and in which the outlet of the circulating water passage is designed and constructed by various improved techniques and which can be used for various purposes such as improving one's health and beauty, etc.

BRIEF DESCRIPTION OF THE DRAWINGS

Same reference numerals are used to designate similar parts throughout the figures.

DETAILED DESCRIPTION OF THE PREFERRED EMBODIMENTS

Figure 1:
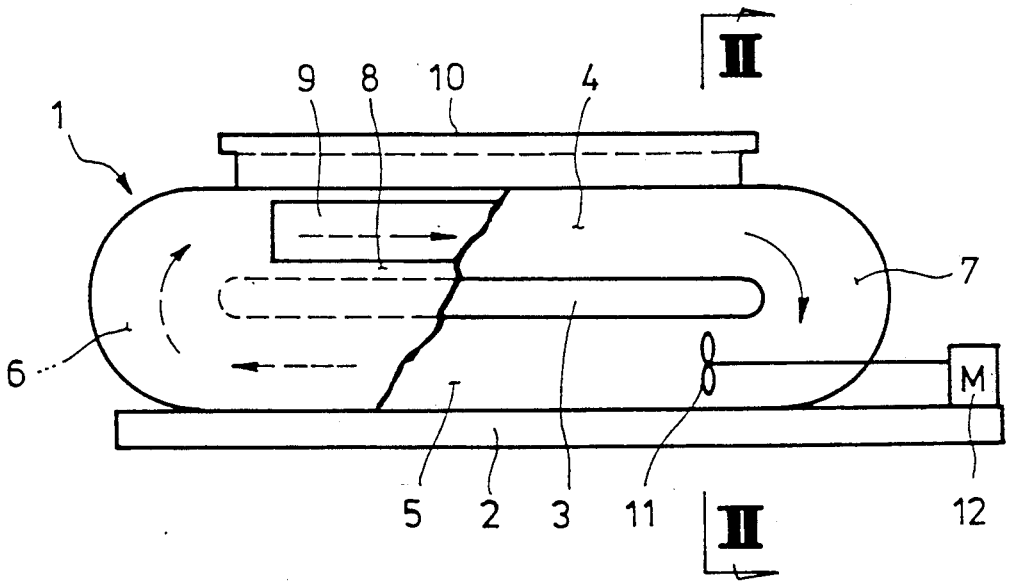
Fig. 1 PRIOR ART
FIG. 1 is a view used to explain one conventional circulating water pool.
Figure 2:
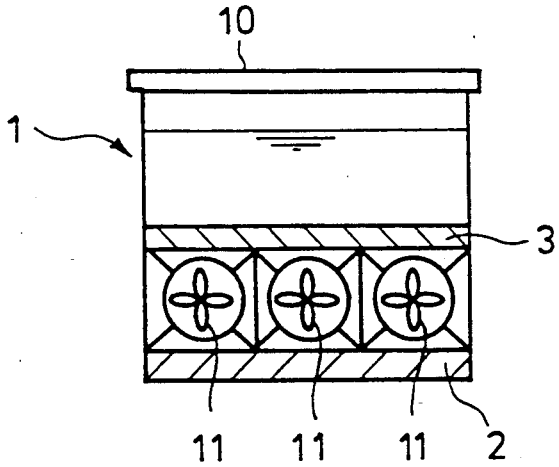
Fig. 2 PRIOR ART
FIG. 2 is a sectional view taken along the line II—II of FIG. 1.
Figure 3:
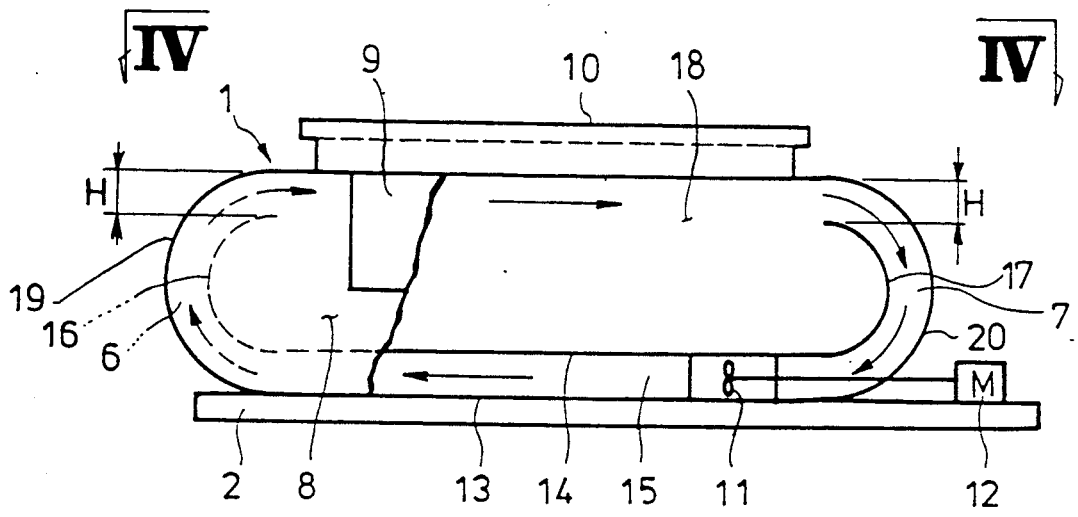
FIG. 3 is a view used to explain a first embodiment of the present invention.
Figure 4:
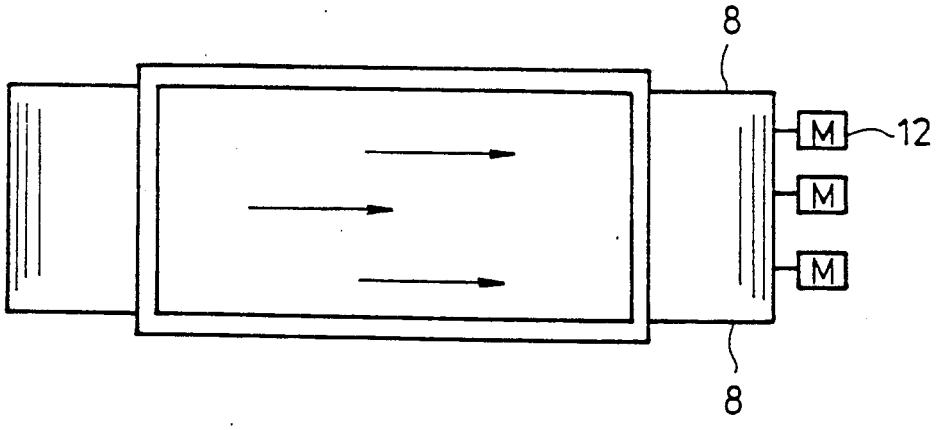
FIG. 4 is a top view thereof when looked in the direction indicated by the line IV—IV of FIG. 3.

Referring now to FIGS. 3 and 4, a first embodiment of the present invention will be described in detail hereinafter.

A bottom partition wall 14 which extends in the traverse direction and is spaced apart upwardly by a suitable distance from the bottom plate 13 of the pool main body 1 which is disposed horizontally and is in the form of an elliptical cylindrical vessel, is supported by the side walls 8 of the main body 1 to define a bottom water passage 15 through the bottom plate 13 and the bottom partition wall 14.

Curved partition walls 16 and 17 which are curved in parallel with a front and a rear curved portion 19 and 20 of the main body 1 extend from free ends of the bottom partition wall 14 to define curved water passages 6 and 7. Therefore, the bottom water passage 15 and the front and rear curved water passages 6 and 7 define together a circulating water passage along the periphery of a water tank 8.

Propellers 11 are disposed in the bottom water passage 15 and are driven by motors 12, respectively, disposed outside of the main body 1.

The height H of the outlet of the front water passage 6 and the inlet of the rear curved water passage 7 is so selected as to be higher than a height (for instance, 35–40 cm) required for permitting a swimmer to swim substantially in a horizontal direction. The front and rear curved partition walls 16 and 17 are in the form of a semicircle whose diameter is between 40 and 50 cm and the height of the bottom water passage is made equal to the above-mentioned height H.

The diameter of each propeller 11 is slightly smaller than the height H and an integer multiple of the propeller 11 is the width of the main body 1. In general, it will suffice to arrange three propellers in the widthwise direction of the bottom water passage 15.

One side wall 8 of the swimming tank 18 of the water tank main body has an observation window 9 made of a transparent material such as glass.

Next, the mode of operation of the first embodiment with the above-described construction will be described.

The upper ends of the curved water passage 6 and 7 are opened into the swimming tank 18 which are communicated with the water passages 6, 7 and 15 so that the water dam freely flow into and out of the swimming tank 18.

The propellers 11 which are arranged in the widthwise direction are driven by the motors 12, respectively, so that the water flows through the water circulation passage consisting of the rear water passage 7, the bottom water passage 15 and the front curved water passage 6.

That is, since the curved water passages and 7 are semicircular in cross section, so that the water flows through the water circulation circuit without countering any resistance and then into the swimming tank 18 from the outlet of the front curved water passage 6 shown at the left side in FIG. 3. Therefore, the water flow is produced only in the upper water layer in the tank 18 in which one swims. Thereafter the water flows into the inlet of the rear curved water passage 7 and passes therethrough to enter the bottom water passage 15, where the water is sucked by the propellers 11. Thus the water is circulated through the bottom water passage 15, the front curved water passage 6, only the upper water layer in the tank 18 and the rear curved water passage 7.

As described above, since the water flow is produced only in the upper water layer in the tank 18 while the intermediate and lower water layers remain in a standstill state, it becomes possible for a swimmer to swim counter to the water flow only in the upper water layer.

The side wall 8 has the transparent observation window 9 fitted with a plate of glass or the like so that a trainer or the like may directly visually observe the swimming forms of the swimmer or the swimming forms may be recorded by a video tape recorder or a camera. Therefore a trainer or the like may correct the swimming forms of a swimmer, teach a beginner how to swim and conduct the intensified training of a swimming player.

Figure 5:
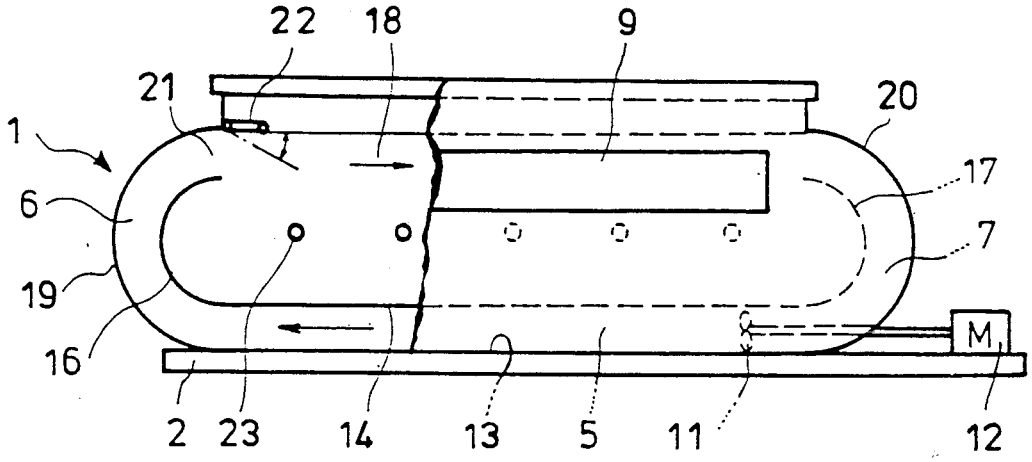
FIG. 5 is a side view of a second embodiment of the present invention.
Figure 6:
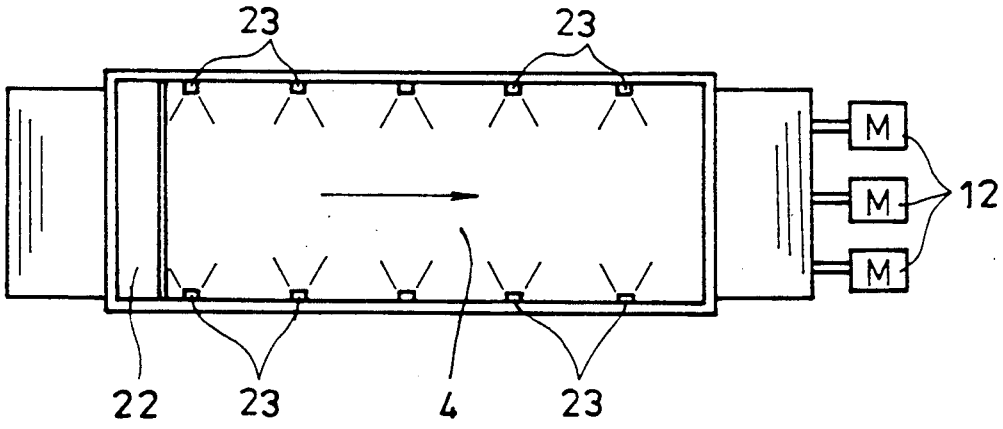
FIG. 6 is a top view thereof.

Next referring to FIGS. 5 and 6, a second embodiment of the present invention will be described which is substantially similar in construction to the first embodiment described above with reference to FIGS. 3 and 4 except that a variable blade 22 is hinged or otherwise attached to the main body above the circulating water outlet 21 of the front curved water passage 6 defined by the front curved portion 19 of the main body 1 and the front curved partition wall 16.

The variable blade 22 can be swung manually or automatically by a hydraulic cylinder or the like.

When the variable blade 22 is swung in the manner described above, the flow rate and direction of the water flow issuing from the outlet 21 of the front curved water passage 6 can be easily varied.

The variable blade 22 is therefore so designed, constructed and attached in order to accomplish the above-described purposes.

In the case of the second embodiment with above-described construction, as in the case of the first embodiment, the water flow is produced only in the upper water layer in the tank 18.

When the variable blade 22 is swung through a relatively large angle, the outlet 21 of the front curved water passage 6 is decreased in cross sectional area so that the flow rate of the water flow in the upper water layer in the tank 18 becomes faster even when the rotational speeds of the propellers 11 remain unchanged.

The variable blade 22 can be swung stepwise or continuously.

When the variable blade or vane 22 is caused to automatically swing by a hydraulic cylinder or the like, the reciprocal upward and downward movement of the variable blade or vane 22 can be repeated for a long period of time. It follows therefore that the flow rate and direction of the water flow can be continuously and arbitrarily varied for a long period of time.

Furthermore it becomes also possible to vary the flow rate and direction of the water flow in stepwise.

In addition to the improvement and studies of the swimming forms of a swimmer and the intensified training for a swimming player in the upper water layer in the tank 18, it is possible to cause the water flow, whose flow rate and direction can be varied arbitrarily as described above, to strike against or impinge on the body of a man/woman remaining stationary in the swimming tank 18 so as to stimulate the human body so that he/she can recover from his/her fatigue and excess fat in the body can be removed, thereby improving his/her health and beauty.

Furthermore, in the case of the treatment by utilizing the water flow, the water flow can be controlled to strike against or impinge of the affected part at any portion of his/her body in a simple manner.

Moreover, in order to conduct medical treatment or recover from his/her fatigue, the water flow is so controlled to sequentially strike against or impinge on a plurality of men and/or women remaining standstill in the swimming tank 18.

The swimming tank 18 can be used not only during the summer but also other seasons by adjusting the temperature of circulating water.

In addition, the circulating pool can be installed in a hospital or home for the purpose of improving one's health and beauty and also can be used as a water tank in which various kinds of fishes such as tropical fishes, golden fishes, carps and so on for the purpose of appreciation or breeding them.

When lighting means 23 are attached to the inner surface of the side walls of the main body, the colors of light emitted from the lighting means are varied and the water flow is made into the turbulent flow and is caused to leap by varying the rotational speeds of the propellers, independently of each other and by suitably controlling the angle of swing of the variable blade or vane 22 so that irregular reflection of light is produced, the visionary or dreamy effect can be attained.

Moreover, the sound-reproducing system may be used together with the circulating water pool so that one can listen to various mood and quiet music.

The water flow, the light means 23 and the music may be combined to utilize the pool as a display or make swimmer feel comfortable.

Furthermore, since the pool is equipped with lighting means 23, it may be used even during the night.

Figure 7:
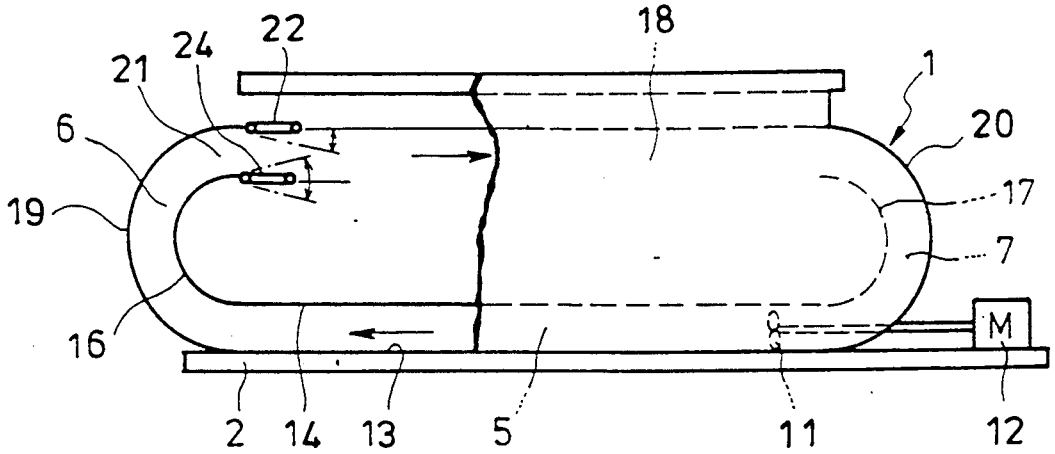
FIG. 7 is a side view of a third embodiment of the present invention.

FIG. 7 illustrates a third embodiment of the present invention which is substantially similar in construction to the second embodiment just described above except that another variable blade or vane 24 is hinged or otherwise attached at the lower portion of the outlet 21 of the front curved water passage 6.

When two variable blades or vanes 22 and 24 are caused to swing alternately, the flow rate of the water flow in the upper water layer in the swimming pool 18 may be further increased and the direction of the water flow may be controlled with a higher degree of accuracy to locally concentrate water flow. Furthermore, because of the provision of the two variable blades or vanes 22 and 24, the range in which the direction of the water flow may be changed is enlarged so that it becomes possible for the water flow to reach the outlet of the swimming tank 18.

The variable vanes 22 and 24 may be swung manually or automatically by hydraulic cylinders or the like.

Figure 8:
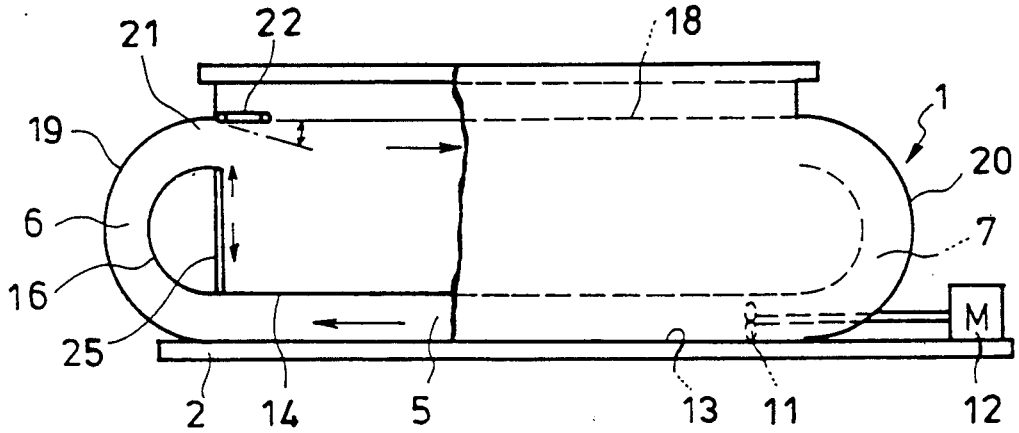
FIG. 8 is a side view of a fourth embodiment of the present invention.

FIG. 8 illustrate a fourth embodiment of the present invention which is substantially similar in construction to the second embodiment described above with reference to FIGS. 5 and 6 except that a sliding plate 25 which slides vertically is disposed under the bottom portion of the circulating water outlet 21 of the front curved water passage 6.

The sliding plate 25 may be automatically moved upwardly or downwardly by a hydraulic cylinder, a screw rod or the like.

When the sliding plate 25 is automatically move upwardly and downwardly, depending upon the position of the sliding plate 25, non-uniform water flow may strike against the sliding plate 25 and become a turbulent flow entraining air bubbles and therefore a special effect can be achieved.

The flow rate can be increased by controlling the sliding plate 25 while the direction of the water flow is controlled by the upper variable blade or vane 22.

When the sliding plate 25 repeatedly continuously moves upward and downward while the swinging motion of the variable blade or vane 22 is repeatedly continued, the effects of the sliding plate 25 and the variable blade or vane 22 can be combined to produce continuously varying water flow in the swimming tank 18.

Figure 9:
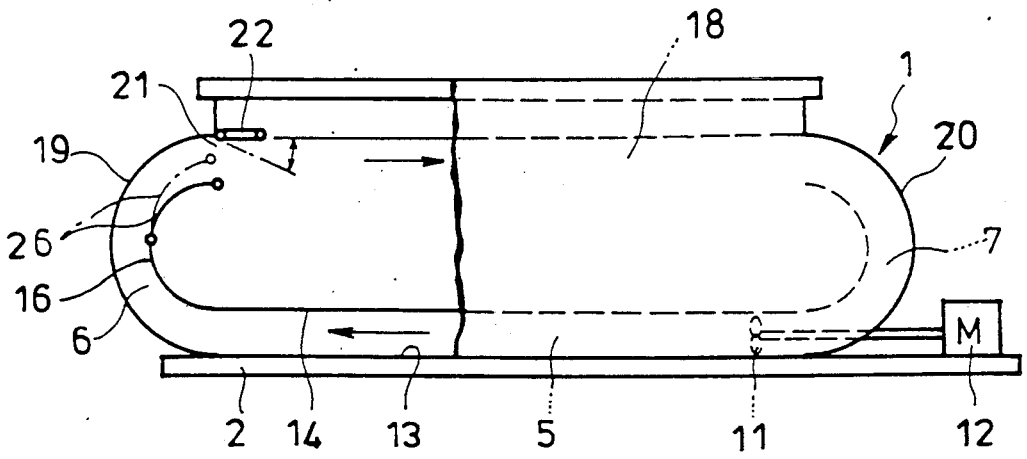
FIG. 9 is a side view of a fifth embodiment of the present invention.

FIG. 9 illustrates a fifth embodiment of the present invention which is substantially similar in construction to the second embodiment described above with reference to FIGS. 5 and 6 except that the upper half of the front curved partition wall 16 is a swinging partition wall 26 whose lower end is hinged or otherwise attached to the upper end of the lower half of the front curved partition wall 16.

While the variable blade or vane 22 controls the direction of the water flow, the swinging partition wall 26 increases or decreases the cross sectional area of the outlet 21 of the front curved water passage 6, thereby varying the flow rate of the water flow.

It is to be understood that the upper water layer flow type circulating water pool in accordance with the present invention is not limited to the above-described embodiments thereof and that various modifications may be effected without leaving the true scope of the present invention.

As described above, the present invention can attain the following various effects, features and advantages:

(1) Since the water is forced to flow only in the upper water layer in the body of water in the swimming tank throughout the opened water surface section thereof, the power consumption of the motors can be remarkably decreased as compared with the case in which the whole body of water in the swimming tank is forced to flow.

(2) Since the water is forced to flow only in the upper water layer in the body of water in the swimming tank throughout the opened surface section thereof, the propellers can be made compact in size and accordingly the capacity of the motors driving the propellers can be decreased.

(3) Because of (2) described above, the circulating water pool main body can be made compact in size so that the fabrication cost can be reduced.

(4) The power consumption is less and the circulating water pool is compact in size so that the circulating water pools in accordance with the present invention can be used even in individual homes.

(5) Since the water flow is permitted only in the upper water layer of the body of water in the swimming tank, a beginner can quickly learn the correct swimming forms.

(6) A swimmer can swim in the water flow which may be varied over a wide range by varying the rotational speeds of the motors and only a portion of the body of water in the tank is circulated so that the flow rate can be quickly and positively varied.

(7) Since the swinging blade or vane is pivoted or hinged at the upper portion of the outlet of the front curved water passage, the water flow rate and direction can be arbitrarily, quickly and easily varied. The flow rate can be more quickly varied as compared with the case in which the flow rate is varied by changing the rotational speeds of the propellers. According to the present invention, no power is needed to vary the flow rate and direction.

(8) The direction of the water flow can be precisely controlled so that the water flow can be directed to any part of the swimming tank and can even reach a deeper portion of the body of water in the swimming tank.

(9) The turbulent flow entraining air bubbles can be produced to stimulate human body.

(10) In the case of the treatment with the water flow or jet, the latter can be so directed to strike at to impinge on the affected portion at any position of the patient remaining standstill in the swimming tank so that the water flow or jet treatment can be easily carried out.

(11) Furthermore, another variable blade or vane or the sliding plate may be installed at the lower portion of the outlet of the front curved water passage or the upper half of the front curved partition wall consists of a swinging partition wall so that the flow rate and direction of the water flow can be more precisely controlled.

What is claimed is:

1. An upper water flow layer type circulating water pool comprising a circulating pool main body with front and rear curved portions; a swimming tank or pool defined by an opening in an upper portion of said circulating water pool main body; an observation window formed in a side of said circulating pool main body; a water circulation passage defined by a bottom partition wall spaced apart from a bottom of said circulating water pool main body and front and rear curved partition walls spaced apart from an inner surface of said front and rear curved portions of said main body within said circulating water pool main body, height of a downstream outlet to a front upper portion of said swimming tank or pool and an upstream inlet to said water circulation passage being approximately equal to a depth required to permit a swimmer to swim in said swimming tank or pool; and means disposed in said water circulation passage for producing the water flow through said water circulation passage, wherein a swingable variable blade or vane is attached to a upper portion of said downstream outlet of said water circulation passage; and is adapted to swing toward or away from said water circulation passage path to respectively impede or permit waterflow therethrough;

and another swingable variable blade or vane is attached to a lower portion of said downstream outlet of said water circulation passage, and is adapted to swing toward or away from said water circulation passage path to respectively impede or permit water flow therethrough.

* * * * *